US005715753A

United States Patent [19]

Hachiya

[11] Patent Number: 5,715,753

[45] Date of Patent: Feb. 10, 1998

[54] APPARATUS FOR FIXING PRINTING PLATE TO PLATE CYLINDER AND REMOVING PRINTING PLATE FROM PLATE CYLINDER

[75] Inventor: Tadashi Hachiya, Kanagawa-ken, Japan

[73] Assignee: Kabushiki Kaisha Toyko Kikai Seisakusho, Japan

[21] Appl. No.: 704,929

[22] Filed: Aug. 28, 1996

[30] Foreign Application Priority Data

Nov. 17, 1995 [JP] Japan ..... 7-299603

[51] Int. Cl.[6] ..... B41F 1/28

[52] U.S. Cl. ..... 401/415.1

[58] Field of Search ..... 101/415.1

[56] References Cited

U.S. PATENT DOCUMENTS

| | | | |
|---|---|---|---|
| 3,353,481 | 11/1967 | Antonucci | 101/389.1 |
| 4,744,297 | 5/1988 | Sardella et al. | 101/415.1 |
| 4,878,407 | 11/1989 | Harrison et al. | 101/389.1 |
| 5,413,043 | 5/1995 | Fuhrmann et al. | 101/415.1 |
| 5,526,746 | 6/1996 | Capdeboscq | 101/415.1 |

FOREIGN PATENT DOCUMENTS

| | | | |
|---|---|---|---|
| 3918977 | 12/1990 | Germany | 101/415.1 |
| 5-439 | 1/1993 | Japan . | |
| 6-155715 | 6/1994 | Japan . | |
| 7-195672 | 8/1995 | Japan . | |

*Primary Examiner*—Edgar S. Burr
*Assistant Examiner*—Amanda B. Sandusky
*Attorney, Agent, or Firm*—Ronald P. Kananen

[57] ABSTRACT

A printing machine in which a plate cylinder 1 is formed with a slit 11 for accepting the leading and trailing edges of a printing plate PP, a plurality of small holes 12 are arranged along the slit 11 and open to the surface of the plate cylinder 1, an air tubular path 2 is connectable both to a suction source 5 and an air delivery source 4 and communicates with the plural small holes 12, and a switching mechanism 3 is disposed in the air tubular path to switch between the air suction operation and the air delivery operation through the opening portions of the plural small holes 12. The switching mechanism 3 is disposed in the air tubular path 2 that lies between the plate cylinder 1 and both of the air suction and delivery sources 5 and 4. An operating unit 34 is disposed in or on the plate cylinder 1 for operating the switching mechanism 3.

5 Claims, 4 Drawing Sheets

APPARATUS FOR FIXING PRINTING PLATE TO PLATE CYLINDER AND REMOVING PRINTING PLATE FROM PLATE CYLINDER

BACKGROUND OF THE INVENTION

1. Technical Field of the Invention

The present invention relates generally to a printing machine in which a plate cylinder is equipped with a printing plate in a printing operation and particularly to an apparatus which easily makes a printing plate fit to a plate cylinder without fail and readily makes the printing plate detach from the plate cylinder when it is desired to remove it therefrom. More specifically, the invention is concerned with an apparatus for fixing a printing plate to, and removing it from, a plate cylinder in the case where a need arises to fit and attach the printing plate to the plate cylinder or to detach the former from the latter, respectively, in a printing machine in which the plate cylinder is adapted to be equipped with a printing plate by bending one of the two parallel end portions of the printing plate at an acute angle and the other end portion thereof at an obtuse angle and then inserting those two bent end portions into a slit that is formed in a surface of the plate cylinder, parallel to an axis of the plate cylinder and with an inclination relative to a radial direction of the plate cylinder.

2. Description of the Prior Art

There is disclosed an apparatus for fitting and fixing a printing plate to a plate cylinder in a printing machine in which the plate cylinder is adapted to be equipped with the printing plate by bending one of the two parallel end portions of the printing plate at an acute angle and the other end portion thereof at an obtuse angle and then inserting those two bent end portions into a slit which is provided in a surface of the plate cylinder, parallel to an axis of the plate cylinder and with an inclination relative to a radial direction thereof, in Japanese Unexamined Utility Model Publication No. Hei 5-439, Japanese Unexamined Patent Publication No. Hei 6-155715 and Japanese Unexamined Patent Publication No. Hei 7-195672.

More specifically, there is disclosed in Japanese Unexamined Utility Model Publication No. Hei 5-439 an apparatus having a plate cylinder which is provided with a groove which is formed parallel to an axial direction of the plate cylinder and with an inclination relative to a radial direction thereof to insert the two parallel end portions of a printing plate, a pair of bores that extend parallel to and across the side surfaces of this groove, a plurality of suction holes which communicate with the above bores and open to both of the side surfaces of the groove and a communicating bore that passes from one end area of the apparatus through the axis of the plate cylinder to communicate with the first mentioned bores, the apparatus having a vacuum pressure supply unit connected via a rotary joint to an end opening portion of the communicating bore.

In the above-mentioned apparatus, the one end portion of the printing plate is engaged with the groove in the plate cylinder to allow the printing plate to be wound round the plate cylinder. And, after the other end portion of the printing plate is inserted into the groove in the plate cylinder, a vacuum pressure is supplied to the suction holes from the vacuum pressure supply unit via the rotary joint, the communicating bore and the first mentioned bores to suck both the end portions of the printing plate to the adjacent surfaces of the groove, thereby fixing the printing plate to the plate cylinder. When the printing plate needs to be removed from the plate cylinder, feed of the vacuum pressure is halted and the suction holes are allowed to communicate with the atmosphere, thereby releasing the printing plate from the printing cylinder.

It should be noted, however, that in the apparatus disclosed in Japanese Unexamined Utility Model Publication No. Hei 5-439, since the suction holes are provided by opening them to both of the two opposing side surfaces across the groove via narrow spaces, it is necessary to perforate holes which penetrate from a surface of the plate cylinder through the side surfaces of the groove, then to close the opening portions of the surface of the plate cylinder and thereafter to finish those portions commensurate with the peripheral surface of the plate cylinder. Such a machining procedure is found to be complicated in preparing the intended apparatus.

Also, it has been found that it is difficult to finish the side surfaces of the groove to which the suction holes are allowed to open, to the extent that the printing plate may airtightly contact with the groove side surfaces. Therefore, the printing plate tends to be incompletely fixed to the plate cylinder and there develops an inconvenience that a loss of the vacuum pressure is incurred.

On the other hand, it is noted that during a printing operation a printing plate which is rotated in contact with an adjacent cylinder is squeezed thereby and in that state the printing plate is slightly fed or advanced beyond its trailing edge which lies downstream in the direction of rotation. Since the end portion of this trailing edge is sucked within the groove, it loses its freedom and such a portion of the printing plate as has been fed or advanced beyond the trailing edge by the squeezing is incapable of being liberated. This should cause a repetitive force of displacement to act on the bent portion on the side of the trailing edge. Thus, there is a fear that a breakage of the printing plate may be brought about at this bending position during a printing operation.

Furthermore, in this apparatus, the detachment of a printing plate is attempted merely by halting the feed of the vacuum pressure to the suction holes and permitting them to switchingly communicate with the atmosphere. Since the printing plate is deformed after the configuration of the surface of the plate cylinder by the action of the pressure caused by contact with a blanket cylinder and thus is firmly adherent to the plate cylinder, it is difficult to remove the end portion of the printing plate which has been inserted into the groove therefrom. There is also a fear that a printing plate which is poor in elasticity or flexibility may be damaged when its end portion is attempted to be removed from the groove and it cannot be used again.

In Japanese Unexamined Patent Publication No. Hei 6-155715 there is disclosed an apparatus in which a plurality of plate-like springs are inserted into a slit and distributed in the longitudinal direction of the slit. The slit is provided so that two parallel end portions of a printing plate may be inserted thereinto and is formed in a plate cylinder parallel to an axis thereof and with an inclination relative to a radial direction thereof. Each spring is preliminarily loaded in a state in which it is inserted into the bottom of the slit and has a pair of leg portions which are pressed against side surfaces across the slit to form a "U"-shaped configuration. One of the leg portions is extended, has a recessed section and terminates at a curved section. Between the one leg portion extended and one side surface of the slit which is adjacent to this leg portion, there are contained both the ends of the printing plate.

In the above-mentioned apparatus, bent portions constituting the two parallel end portions of the printing plate which are inserted into the slit of the plate cylinder for attachment of the printing plate thereto are sandwiched between one side surface of the slit and the one spring leg portion extended adjacent to the above side surface of the slit to tighten the printing plate.

It should be noted, however, that since the apparatus disclosed in Japanese Unexamined Patent Publication No. Hei 6-155715 represents a mechanism in which a spring steel made spring member that is provided with a pair of "U"-shaped leg portions is inserted into the slit, it is necessary to deeply machine the slit there. But, since the distance between the side surfaces of the slit is narrow, it is difficult to achieve its machining there.

Also, since the springs rust within the slit, there is a fear that it may be unable to insert the end portions of the printing plate uniformly into the slit. In addition, there is a fear that the rust of the springs may damage them or lower their strength so that the printing plate can be only insufficiently fastened to the plate cylinder.

Also, it is noted that since the springs are not fixed, they may be displaced in the slit. It follows therefore that when the printing plate is attempted to be fastened there, the uniformity in the direction of width of the plate cylinder may be destroyed. It is also possible that the springs may slide out of the slit.

It is further noted that no care whatsoever is taken in the above-mentioned prior art at an instance when the printing plate is to be taken out of the slit. Since a printing plate is deformed after the configuration of the surface of a plate cylinder by the action of the pressure caused by contact with a blanket cylinder and then is firmly adherent to the plate cylinder, it is certainly difficult to remove the end portions of the printing plate which have been inserted and sandwiched between the spring in the slit and one side surface of the slit. Here again, there is also a fear that a printing plate that is poor in its elasticity or flexibility may be damaged when its end portions are detached from the slit and it may be impossible to use it again.

In Japanese Unexamined Patent Publication No. Hei 7-195672 there is disclosed an apparatus having a slit that is formed in a plate cylinder, parallel to an axis thereof and with an inclination relative to a radial direction thereof to insert the two parallel end portions of a printing plate, and including a switchable unit arranged parallel to an engagement edge portion of the slit and in an area adjacent to the edge portion in order to lift a reverse side of the printing plate, the above unit being, for example, a plurality of nozzles for discharging a pressurized air.

This apparatus is designed to hold the bent portions of the two parallel ends of the printing plate which are inserted into the slit of the plate cylinder for attaching the printing plate to the plate cylinder, between a pair of side surfaces across the slit, which are opposing to each other with a space between them that is slightly greater than the two times thickness of the printing plate. On the other hand, in case the printing plate is to be removed, the apparatus is designed to lift the printing plate so as to detach from the slit one of the two bent parallel end portions of the printing plate which have been inserted in the slit, by means of the switchable unit acting on the reverse side of the printing plate, for example, by means of the plural nozzles discharging the pressurized air at the same time.

It should be noted, however, that the apparatus disclosed in Japanese Unexamined Publication No. Hei 7-195672 is aimed to resolve the problem that the printing plate tends to be deformed after the configuration of the surface of a plate cylinder by the action of the pressure caused by contact with a blanket cylinder and then to be firmly adherent to the plate cylinder, thus making it difficult to remove the printing plate from the plate cylinder. Thus, with respect to the fixing of the printing plate to the plate cylinder in this apparatus, both end portions of the printing plate are merely inserted into the narrow slit of the plate cylinder, and the trailing edge of the printing plate which lies downstream in the direction of rotation while a printing operation is carried out is not particularly fixed.

Accordingly, there may be liberated a portion of the printing plate, that is fed into the side of its trailing edge by the action of its squeezing during a printing operation, with a slight clearance in the slit. However, every time the plate cylinder is rotated, since the pressure caused by contact with a blanket cylinder acts on the slightly upstream side of the portion of the trailing edge which has been inserted into the slit, the downstream side thereof will be slightly lifted out of the surface of the plate cylinder by stiffness characteristics of the printing plate and through a further rotation of the plate cylinder the slightly lifted portion will be pressed to the plate cylinder by the action of the pressure caused by contact with a blanket cylinder. With this series of actions being repeated while a printing operation is carried out, it is found that a repetitive force of displacement will be caused to act on a particular position of the printing plate. As a result, there has been a fear that the printing plate may break on the side of its trailing edge.

SUMMARY OF THE INVENTION

The present invention has been achieved in view of the foregoing problems in the prior art and has its object to provide an apparatus which can facilitate a machining operation as required and further whereby if there is such a portion of a printing plate which is squeezed to be fed into its trailing edge side while a printing operation is being carried out, the printing plate can be fixed to a plate cylinder without fail and yet the printing plate can be readily removed from the plate cylinder.

In order to attain the above-mentioned object, there is provided in accordance with the present invention, in a first aspect thereof, an apparatus for fixing a printing plate to a plate cylinder and removing the printing plate from the plate cylinder in a printing machine in which the plate cylinder is equipped thereon with a printing plate, the apparatus comprises: a slit arranged in the plate cylinder, the slit being formed with an inclination relative to a radial direction of the plate cylinder and parallel to an axis thereof; a plurality of small holes arranged along the slit, the plurality of small holes opening to a surface of the plate cylinder in close vicinity to the slit and on the side in which one of edges of the slit makes an obtuse angle with a tangent to a peripheral line of the surface of the plate cylinder; an air tubular path connected with an air suction source and an air delivery source on the one side thereof and communicating with each of the plural small holes on the other side thereof, the air tubular path enabling an air suction operation and an air delivery operation to be carried out through each of opening portions of the plural small holes; and a switching mechanism disposed in the air tubular path to switch between the air suction operation and the air delivery operation through each of the opening portions of the plural small holes.

According to a further feature of the first aspect of the present invention, the apparatus is characterized in that the switching mechanism for switching between the air suction operation and the air delivery operation through each of the opening portions of the plural small holes is disposed in the air tubular path which lies between the plate cylinder and both of the air suction and delivery sources and that an operating unit for operating the switching mechanism is disposed in or on the plate cylinder.

According to the another feature of the first aspect of the present invention, the apparatus is characterized in that the switching mechanism for switching between the air suction operation and the air delivery operation through each of the opening portions of the plural small holes is disposed in or on the plate cylinder together with an operating unit therefor.

In the above-mentioned apparatus, it is preferred that each of the opening portions of the plural small holes has a diameter of not more than 2 mm.

In the above-mentioned apparatus, it is also preferable that each of the opening portions of the plural small holes is arranged within an area where a distance from the intersection of a center line of the width of the slit and a peripheral line of the surface of the plate cylinder does not exceed 8 mm.

In the above-mentioned apparatus, it is further desirable that each of the opening portions of the plural small holes has a diameter of not more than 2 mm and is arranged within an area where a distance from the intersection of a center line of the width of the slit and a peripheral line of the surface of the plate cylinder does not exceed 8 mm.

Advantages which are gained according to the present invention are set forth below.

In case of equipping a plate cylinder with a printing plate, by inserting the two bent parallel portions of the printing plate into a slit arranged in the plate cylinder, it should be noted that since, after the printing plate being fitted to the plate cylinder, the trailing edge side thereof is sucked and firmly fixed to the plate cylinder without fail, there can be effectively prevented a repetitive force of displacement which may be created at a particular position of the printing plate every time the plate cylinder is rotated because the trailing edge side of the printing plate is slightly lifted up from the surface of the plate cylinder for the reason of stiffness characteristics of the printing plate while a printing operation is carried out. Also, if the printing plate which is squeezed during a printing operation is slightly fed into the trailing edge side of the printing plate, it can be seen that a portion thereof which is fed into the-trailing edge side will be able to be liberated with a clearance within the slit and, in a state in which it is so liberated, the trailing edge side is able to continue to be firmly fixed to the plate cylinder by suction. Hence, there can be prevented a repetitive force of displacement which may be created at the bent position of the trailing edge side.

As a result, a printing plate is effectively prevented from being broken during a printing operation.

In addition, since a plurality of small holes which constitute a suction portion that sucks the trailing edge side of the printing plate are connected via a switching mechanism to an air suction source and an air delivery source, it can be seen that by only operating the switching mechanism, the trailing edge side of the printing plate which has been fixed by suction to the surface of the plate cylinder can be detached therefrom and at the same time the printing plate can be lifted from the surface of the plate cylinder while permitting a part of or all of the trailing edge side end portion to be extracted from the slit. It therefore follows that the printing plate can be quite easily removed from the plate cylinder.

As a result, it will be seen that the printing plate can be readily detached, without being damaged even slightly, from the plate cylinder, thus permitting itself to be utilized again.

In addition to the above, according to the present invention, since an operation for fixing a printing plate to a plate cylinder and an operation for detaching the printing plate from the plate cylinder can be performed by using an operating unit mounted in the plate cylinder, it should be apparent that those fixing and detaching operations can be readily switched over and carried out by a single operator.

On the other hand, it is noted that according to the present invention, a suction portion for sucking the trailing edge side of the printing plate and a detachment portion for detaching the trailing edge side which has been sucked from the plate cylinder are simply configured to be common so that either of the fixing operation and the detaching operation may be selectively performed by simply operating the switching mechanism. Also, since a plurality of small holes which on the one hand constitute the suction portion and on the other hand constitute the detachment portion are so configured as to open to a surface of the plate cylinder including a chamfered portion, which lies at an edge of the slit with which the printing plate can be fitted over the plate cylinder, that is, they open to the position that can be externally viewed, it is important to note that the machining of these plural small holes can be carried out much more easily than the one according to the prior art.

As a consequence, according to the present invention, the frequency of trouble can be drastically lowered, the maintenance can be readily supervised and the manufacturing cost can be reduced.

BRIEF DESCRIPTION OF THE DRAWINGS

These and other objects, features and advantages of the present invention will become more readily apparent from a reading of the following specific description that is made with reference to the accompanying drawings in which.

DESCRIPTION OF THE PREFERRED EMBODIMENTS

Figure 1:
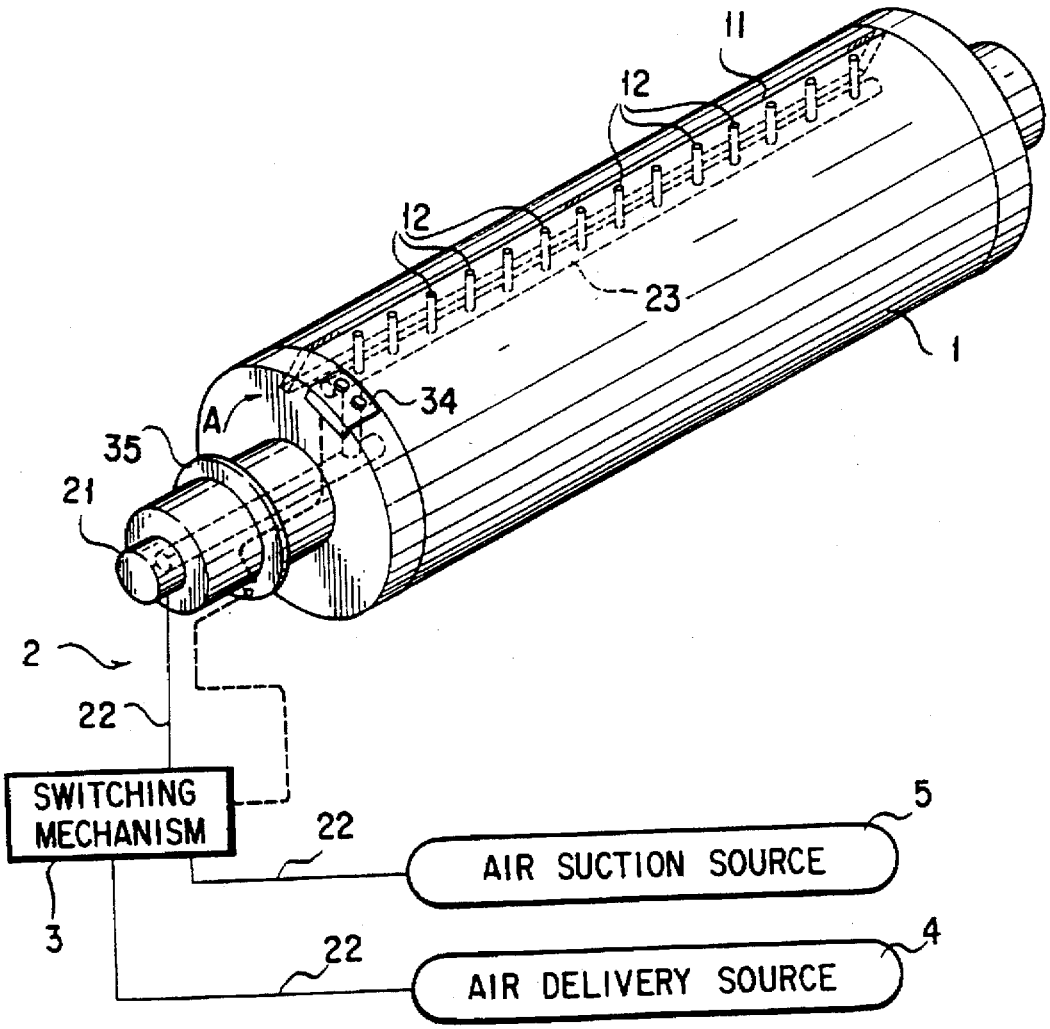
FIG. 1 a perspective view diagrammatically illustrating one embodiment according to the present invention.

An explanation will be now given with respect to embodiments according to the present invention with reference to the accompanying drawings.

A plate cylinder 1 is provided with a slit 11 which is formed parallel to an axis of the plate cylinder 1 and with an inclination relative to a radial direction thereof and which opens to a surface of the plate cylinder. There are formed two edges, i.e., an acute angle edge which makes an acute angle with a tangent to a peripheral line of the plate cylinder 1 and an obtuse angle edge which makes an obtuse angle with the above-mentioned tangent, both of which are situated at the opening portion of the slit 11 and are parallel to the axis of the plate cylinder. These two edges are each adequately chamfered so that a printing plate PP may closely fit to the plate cylinder 1 without difficulty.

The plate cylinder 1 is also provided with a plurality of small holes 12 which are located in close vicinity to the slit 11, are aligned therealong, and open to a surface of the plate cylinder 1 on the side of the obtuse angle edge.

It is preferred that each of the plural small holes 12 should have a diameter not greater than 2 mm so that they may have little influence on a printing surface, and that the printing plate PP may be fastened onto the plate cylinder 1 without fail. To this end, it is preferable that the above-mentioned plural small holes 12 should each be located in an area that is spaced from a point of intersection of a center line of the width of the above-mentioned slit 11 and a peripheral line on the surface of the plate cylinder 1 by a distance not greater than 8 mm and should be open to the surface of the plate cylinder 1 in a chamfered zone 11*a* and/or in the vicinity thereof that is higher in finishing accuracy and better in adhesiveness by the printing plate PP than the above-mentioned chamfered zone 11*a*. The size of the area in which the plural small holes 12 are formed in a direction along the slit 11 is desirably set to be slightly shorter than the width PL of the printing plate PP that is to be fitted over the plate cylinder 1.

If the opening portions of the plural small holes 12 should each have a diameter greater than 2 mm and their areas as mentioned above should each be spaced from the point of intersection of the center line of the width of the slit 11 and the peripheral line on the surface of the plate cylinder 1 by a distance greater than 8 mm, it should be noted that an undesirable effect will develop such as that in which adversely the contours of these small holes 12 can be printed on a surface to be printed normally.

It should be also noted at this point that the lowest limit of the diameter of the opening portion of each of the plural small holes 12 needs not to be specifically determined if the air can be passed through them without any resistance, and it is practically determined by the machining technique to be taken into account. Also, the approachable limit of the location of the opening portion of each of the plural small holes 12 to the center line of the width of the slit 11 is, as noted above, determined by the chamfered portion 11*a* of the slit 11.

It will be seen that the other end of each of the plural small holes 12 is arranged to open to the inner wall of a vent bore 23 which is formed inside of the plate cylinder 1 and constitutes the end portion of an air tubular path 2. The vent bore 23 is so arranged as to extend parallel to an axis of the plate cylinder 1 inside thereof and to open to an end surface at an axial end of the plate cylinder 1. The opening position of the vent bore 23 is preferably the center of the end surface of the axial end.

On the other hand, the opening portion of the vent bore 23 is connected, via a suitable joint means 21, to a pipe arrangement 22 which constitutes the air tubular path 2 outside of the plate cylinder 1. The joint means 21 is constituted, for example, by a rotary joint.

In the embodiment shown in FIG. 1, it will be seen that the pipe arrangement 22 which is connected to the vent bore 23 is provided with a suitable switching mechanism 3. On the one side of the switching mechanism 3, which does not face the plate cylinder 1, there is divided into two paths, one of which is connected to a source of air supply 4 that constitutes an air delivery source, and the other of which is connected to a source of pressure reduction 5 that constitutes an air suction source.

Figure 4:
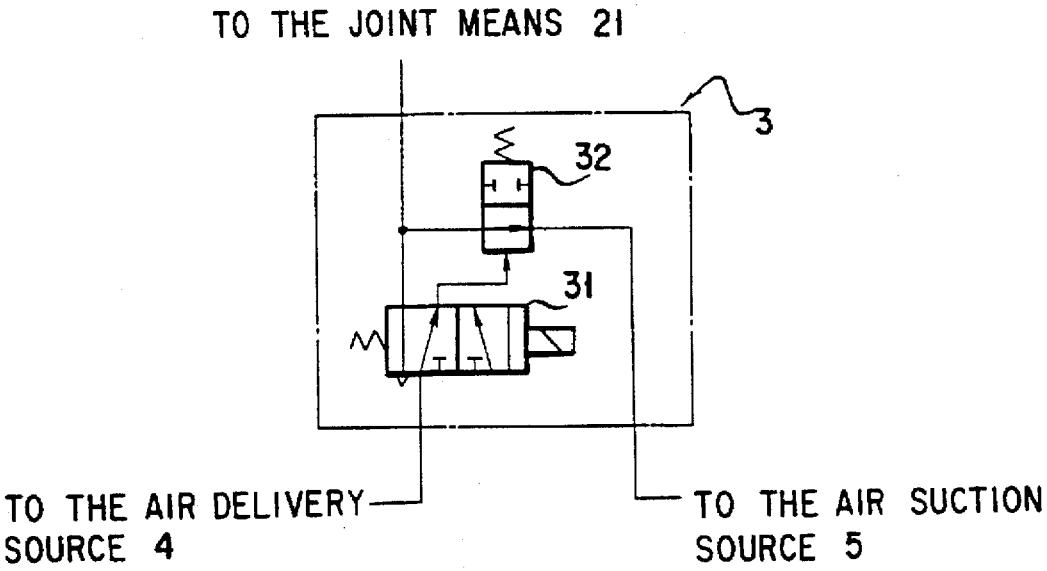
FIG. 4 is a constructive view diagrammatically illustrating one embodiment of a switching mechanism as shown in FIG. 1.
Figure 5:
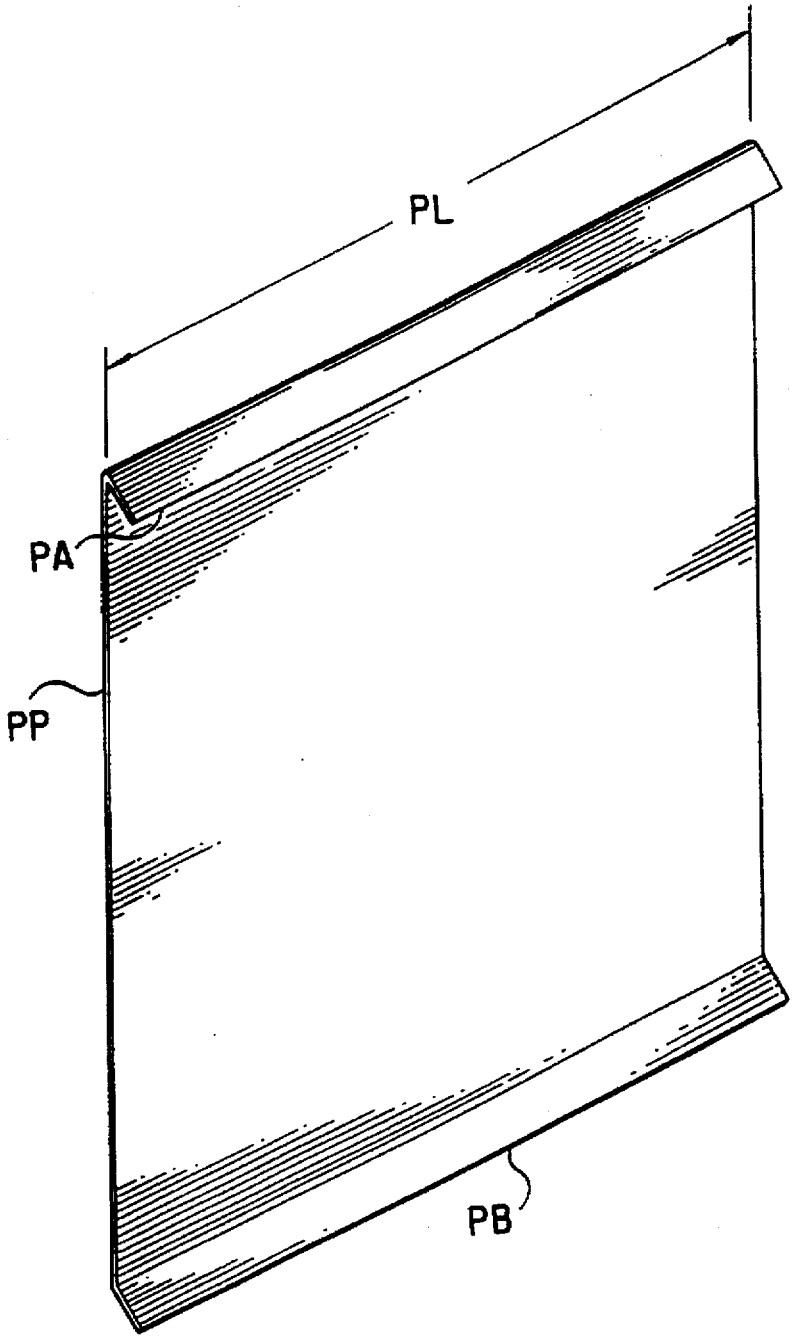
FIG. 5 is a perspective view of a printing plate having a pair of bent parallel end portions which are prepared for attachment to the plate cylinder shown in FIG. 1.

The above-mentioned switching mechanism 3 is constituted, for example, by an electromagnetic valve 31 and a master valve 32 in combination, as shown in FIG. 4. In this constitution, an operating unit 34 for the switching mechanism 3 is arranged in the side portion of the plate cylinder 1 as shown in FIG. 1 and is operated to send an operating signal via a slip ring 35 to the electromagnetic valve 31, thereby performing a switching operation. On the other hand, the master valve 32 is switchingly operated by an air pressure which is fed thereto via the electromagnetic valve 31.

Figure 2:
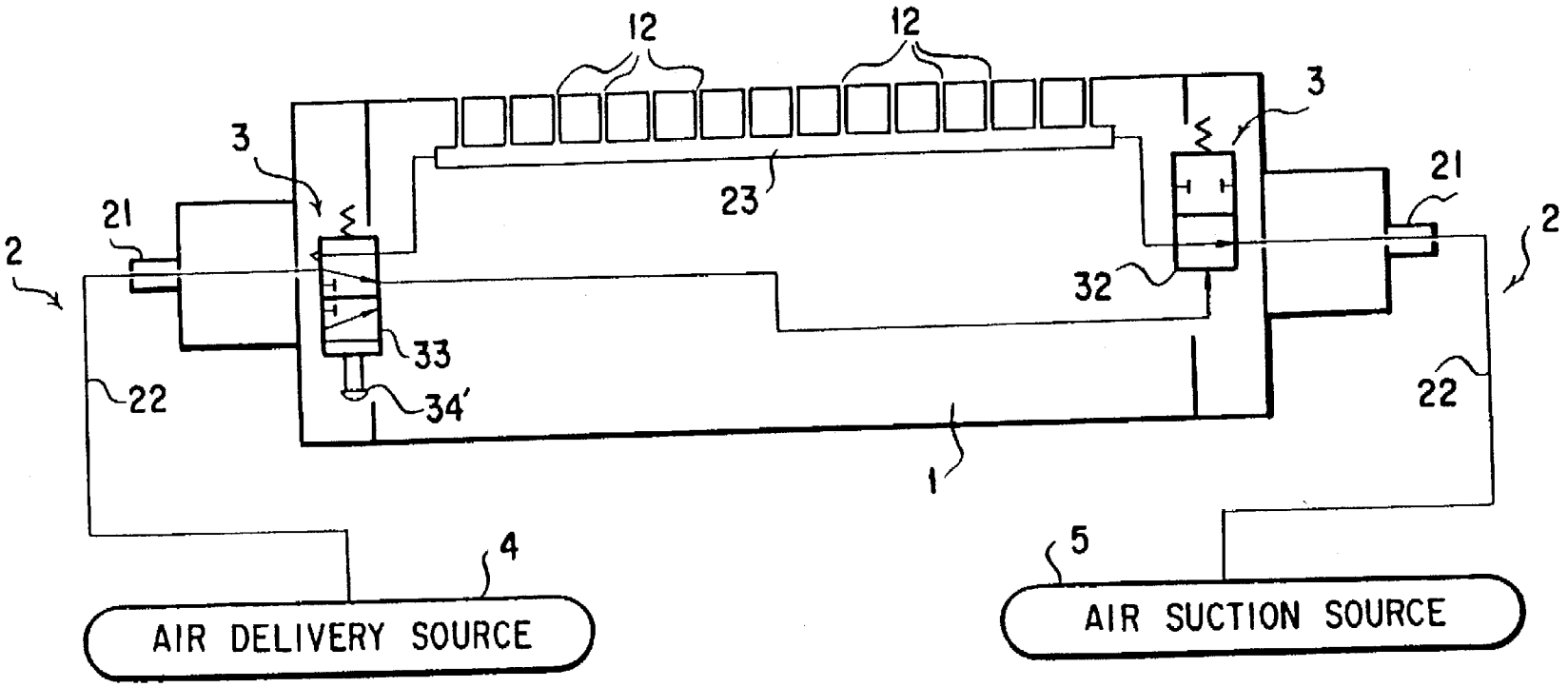
FIG. 2 a constructive view diagrammatically illustrating another embodiment according to the present invention.

In another embodiment as shown in FIG. 2, it will be seen that a vent bore 23 is connected to the end surface opening portions at both axial ends of a plate cylinder 1 via a pair of valves which are arranged in or on a plate cylinder 1 and constitute the switching mechanisms 3, respectively. The two opening portions are so arranged as to communicate via a pair of joint means 21 and pipe arrangements 22, respectively, to a source of air supply 4 that constitute an air delivery source and a source of pressure reduction 5 that constitutes an air suction source.

The above-mentioned valves which respectively constitute the switching mechanisms 3 are, for example, as shown in FIG. 2, a manually operated valve 33 which is interposed between the air delivery source 4 and the vent bore 23 and a master valve 32 which is interposed between the air suction source 5 and the vent bore 23. The manually operated valve 33 is operated by an operating unit 34' which is jointly disposed therewith whereas the master valve 32 is operated by an air pressure which is fed thereto via the manually operated valve 33.

It can be seen that the air delivery source 4 is, for example, an air compressor whereas the air suction source 5 is, for example, a vacuum pump.

At this point it should be noted that the air tubular path 2 is provided with a filter, a regulator, a pressure control valve, a flow rate control valve, a stop valve and so forth (not shown) according to demand.

Under the construction mentioned-above, prior to undertaking several operations as required for operating a printing machine, the air delivery source 4 and the air suction source 5 are operated.

In case of fitting a printing plate over the plate cylinder, both end portions of a leading edge side and a trailing edge side of the printing plate are inserted into the slit. That is, the leading edge side end portion of the printing plate is almost closely fitted on the acute angle edge of the slit whereas the trailing edge side end portion of the printing plate is almost closely fitted on the obtuse angle edge of the slit.

More specifically, when the slit 11 becomes in the state where the bent end portion with an acute angle, which constitutes one end portion of the printing plate PP, that is, the leading edge side end portion PA, can be inserted into the slit by rotating the plate cylinder 1, the plate cylinder 1 is made to stop rotating. Then, the leading edge side end portion PA is inserted into the slit 11.

The acute angle edge of the slit 11 is so chamfered that this acute angle edge line may almost perfectly fit a curved line of the bent portion of the printing plate PP which is bent at an acute angle. Thus, by inserting the leading edge side end portion PA of the printing plate PP into the slit 11, the bent portion of the printing plate PP which is bent at an acute angle is almost closely fitted on the acute angle edge of the slit 11.

Figure 3:
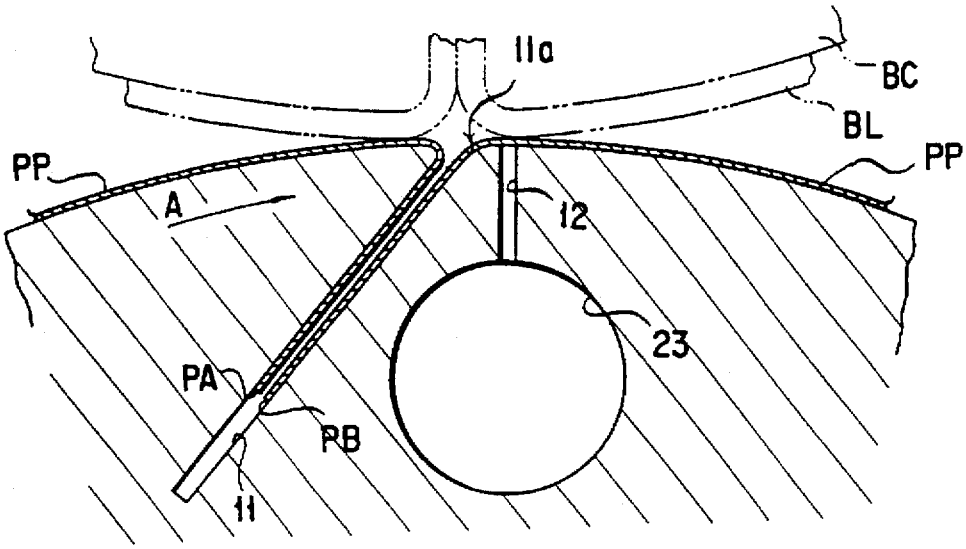
FIG. 3 an enlarged partial cross-sectional view diagrammatically illustrating a portion of a plate cylinder which is cut in a direction perpendicular to an axis of the plate cylinder as shown in FIG. 1.

Thereafter, while the bent side with an obtuse angle, which constitutes the other end portion of the printing plate PP, that is, the trailing edge side, is being lightly drawn, the plate cylinder 1 is slowly rotated in the same direction as its rotation at the time of operating the printing machine, that is, in the direction of its rotation shown by an arrow A in FIGS. 1 and 3. As the plate cylinder 1 is so rotated, the printing plate PP is displaced with its leading edge side ahead according to the rotation of plate cylinder 1 and then is wound round the plate cylinder 1.

The plate cylinder 1 is made to stop rotating when the slit 11 becomes in the state where the plate cylinder 1 makes nearly one revolution, the printing plate PP is wound nearly up to its trailing edge side and the bent end portion with the obtuse angle of the printing plate PP, that is, the trailing edge side end portion PB, can be inserted into the slit.

Subsequently, the trailing edge side end portion PB is inserted into the slit 11 from the side of the obtuse angle edge of the slit 11 along one side surface thereof. Here again, the obtuse angle edge of the slit 11 has been so chamfered that this obtuse angle edge line may almost perfectly fit a curved line of the bent portion of the printing plate PP which is bent at an obtuse angle. Thus, by inserting the trailing edge side end portion PB into the slit 11, the entire rear surface of the printing plate PP including the bent portion with the obtuse angle becomes in nearly uniform contact with the surface of the plate cylinder 1.

In case of fixing the printing plate to the plate cylinder, the switching mechanism in the air tubular path 2 is switched to the air suction operation. Thus, by virtue of sucking air through the opening portions of the plural small holes, the trailing edge side portion of the printing plate sticks to the plate cylinder.

According to the embodiments of the present invention as shown in FIGS. 1 and 2, it should be noted that in either case, when the switching mechanism 3 is not operated, the vent bore 23 remains connected with the air suction source 5. Therefore, the opening portions of the plural small holes 12 communicated with the vent bore 23 are in a state of sucking air. This continued suction, as mentioned above, makes the trailing edge side portion of the printing plate PP whose entire rear surface is in contact with the peripheral surface of the plate cylinder 1 stick to the plate cylinder 1. Consequently, the printing plate PP is continuously fixed firmly to the plate cylinder 1.

When the opening portions of the plural small holes 12 are provided at a short distance from the side rim of the chamfered portion 11*a* of the obtuse angle edge of the slit 11, the printing plate PP is squeezed during a printing operation by being rotated in contact with a peripheral surface which is adjacent to the plate cylinder 1, for example, with the surface of the blanket BL of a blanket cylinder BC. However, even if the printing plate PP is fed slightly into the trailing edge side which is on the downstream side of the direction of rotation in the state of the printing operation, the portion which has been fed into the above-mentioned side can be liberated with the clearance in the slit 11 towards the trailing edge side and a rear portion of the printing plate PP which newly becomes opposite to the opening portions of the plural small holes 12 sticks to the plate cylinder by means of these small holes.

It follows therefore that there is not formed in the printing plate PP a portion which is repetitively displaced every time the plate cylinder 1 is rotated and thus there is not created a breakage of the printing plate that has been a critical problem in the prior art.

As set forth in the foregoing description, when a printing operation is carried out with a printing plate PP fixed to the plate cylinder 1 according to the present invention, it has now become apparent that the printing plate PP is adapted itself to the configuration of the peripheral surface of the plate cylinder 1 by the action of the pressure caused by contact with a blanket cylinder and that the degree of close contact between the printing plate and the plate cylinder is drastically increased. Accordingly, this might lead to a consideration that when the printing plate PP is to be detached from the plate cylinder 1, a great difficulty will be encountered in drawing out the trailing edge side end portion PB from the slit 11.

According to the present invention, however, it should be noted that an arrangement is made, in which when a printing plate is to be detached from a plate cylinder, a switching mechanism in an air tubular path is switched to initiate the air delivery operation so that air may be delivered and exhausted through the opening portions of a plurality of small holes. This will create an air layer between the printing plate and the plate cylinder, thus releasing the close contact between them to allow the printing plate to be readily detached from the plate cylinder.

More specifically, an operating unit 34 or 34' for a switching mechanism 3 is manipulated to operate the switching mechanism 3 so as to connect a vent bore 23 with an air delivery source 4, thereby delivering and exhausting air through the opening portions of the plural small holes 12 which communicate with the vent bore 23.

By virtue of the air delivery and exhaust through these plural small holes 12, the air layer will be created between the printing plate PP and the plate cylinder 1 to release the close contact between them, thereby readily detaching the printing plate PP from the plate cylinder 1. In addition, the trailing edge side of the printing plate PP will be greatly blown up from the plate cylinder 1 to permit a part of or all of the trailing edge side end portion PB to be drawn out from the slit 11.

Next, after the trailing edge side end portion PB is completely detached from the slit 11, while the trailing edge side of the printing plate PP is being drawn out, the plate cylinder 1 is slowly rotated in the opposite direction of its rotation during the printing operation, that is, in the opposite direction of its rotation shown by the arrow A in FIGS. 1 and 3 so as to draw and peel the printing plate PP off the plate cylinder 1.

Then, with nearly one such rotation of the plate cylinder 1, the printing plate PP is drawn and peeled off the plate cylinder 1 nearly up to the leading edge side thereof. When the slit 11 becomes in the state where the leading edge side end portion PA of the printing plate PP can be drawn out therefrom, the plate cylinder 1 is stopped rotating. Now, the leading edge side end portion PA of the printing plate PP is drawn out from the slit 11 so as to remove the printing plate PP from the plate cylinder 1.

In connection with a construction and a process as mentioned above, it should be noted that the switching mechanism 3 needs not to be limited to those as shown in FIGS. 2 and 4 but may in another construction be configured to be switchable to a neutral state in which the plural small holes 12 are connected with neither the air delivery source 4 nor the air suction source 5.

While the present invention has hereinbefore been described with respect to certain illustrative embodiments thereof, it will be readily appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. An apparatus for fixing a printing plate to a plate cylinder and removing the printing plate from the plate cylinder in a printing machine in which the plate cylinder is equipped thereon with a printing plate, comprising:

a slit arranged in said plate cylinder, said slit being formed with an inclination relative to a radial direction of said plate cylinder and parallel to an axis thereof;

a plurality of small holes arranged along said slit, said plurality of small holes opening to a surface of said plate cylinder in close vicinity to said slit and on the side in which one of the edges of said slit makes an obtuse angle with a tangent to a peripheral line of the surface of said plate cylinder;

an air tubular path connected with an air suction source and an air delivery source on the one side thereof and communicating with each of said plural small holes on the other side thereof, said air tubular path enabling an air suction operation and an air delivery operation to be carried out through each of opening portions of said plural small holes; and a switching means disposed in said air tubular path to switch between said air suction operation and said air delivery operation through each of said opening portions of said plural small holes;

wherein said switching means for switching between said air suction operation and said air delivery operation through each of said opening portions of said plural small holes is disposed in said air tubular path which lies between said plate cylinder and both of said air suction and delivery sources, and that an operating unit for operating said switching means is disposed in or on said plate cylinder.

2. An apparatus for fixing a printing plate to a plate cylinder and removing the printing plate from the plate cylinder in a printing machine in which the plate cylinder is equipped thereon with a printing plate, comprising:

a slit arranged in said plate cylinder, said slit being formed with an inclination relative to a radial direction of said plate cylinder and parallel to an axis thereof;

a plurality of small holes arranged along said slit, said plurality of small holes opening to a surface of said plate cylinder in close vicinity to said slit and on the side in which one of the edges of said slit makes an obtuse angle with a tangent to a peripheral line of the surface of said plate cylinder;

an air tubular path connected with an air suction source and an air delivery source on the one side thereof and communicating with each of said plural small holes on the other side thereof, said air tubular path enabling an air suction operation and an air delivery operation to be carried out through each of opening portions of said plural small holes; and a switching means disposed in said air tubular path to switch between said air suction operation and said air delivery operation through each of said opening portions of said plural small holes;

wherein said switching means for switching between said air suction operation and said air delivery operation through each of said opening portions of said plural small holes is disposed in or on said plate cylinder together with an operating unit therefor.

3. An apparatus for fixing a printing plate to a plate cylinder and removing the printing plate from the plate cylinder, as set forth in claim 1 or 2, wherein each of said opening portions of said plural small holes has a diameter of not more than 2 mm.

4. An apparatus for fixing a printing plate to a plate cylinder and removing the printing plate from the plate cylinder, as set forth in claims 1 or 2, wherein each of said opening portions of said plural small holes is arranged within an area where a distance from the intersection of a center line of the width of said slit and a peripheral line of said surface of said plate cylinder does not exceed 8 mm.

5. An apparatus for fixing a printing plate to a plate cylinder and removing the printing plate from the plate cylinder, as set forth in claims 1 or 2, wherein each of said opening portions of said plural small holes has a diameter of not more than 2 mm and is arranged within an area where a distance from the intersection of a center line of the width of said slit and a peripheral line of said surface of said plate cylinder does not exceed 8 mm.

* * * * *

UNITED STATES PATENT AND TRADEMARK OFFICE

CERTIFICATE OF CORRECTION

PATENT NO. : 5,715,753
DATED : February 10, 1998
INVENTOR(S) : Tadashi Hachiya

It is certified that error appears in the above-indentified patent and that said Letters Patent is hereby corrected as shown below:

TITLE PAGE

Item [73] should read:

Assignee: Kabushiki Kaisha Tokyo Kikai Seisakusho

Signed and Sealed this

Seventh Day of July, 1998

Bruce Lehman

*Attest:*

BRUCE LEHMAN

*Attesting Officer*

*Commissioner of Patents and Trademarks*